US012514424B2

(12) United States Patent
Lee et al.

(10) Patent No.: US 12,514,424 B2
(45) Date of Patent: Jan. 6, 2026

(54) DISHWASHER

(71) Applicant: LG Electronics Inc., Seoul (KR)

(72) Inventors: Youmin Lee, Seoul (KR); Jindong Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 195 days.

(21) Appl. No.: 18/280,441

(22) PCT Filed: Jan. 28, 2022

(86) PCT No.: PCT/KR2022/001581
§ 371 (c)(1),
(2) Date: Sep. 5, 2023

(87) PCT Pub. No.: WO2022/186488
PCT Pub. Date: Sep. 9, 2022

(65) Prior Publication Data

US 2024/0148219 A1 May 9, 2024

(30) Foreign Application Priority Data

Mar. 5, 2021 (KR) ..... 10-2021-0029555

(51) Int. Cl.
*A47L 15/42* (2006.01)
*A47L 15/23* (2006.01)

(52) U.S. Cl.
CPC ..... *A47L 15/4214* (2013.01); *A47L 15/23* (2013.01); *A47L 2601/03* (2013.01)

(58) Field of Classification Search
CPC ..... A47L 15/22; A47L 15/23
See application file for complete search history.

(56) References Cited

U.S. PATENT DOCUMENTS

2014/0069469 A1* 3/2014 Choi ..... A47L 15/10 134/102.2
2017/0354312 A1 12/2017 Woo et al.
2020/0113409 A1 4/2020 Lee

FOREIGN PATENT DOCUMENTS

CN 208243536 U 12/2018
CN 109394111 A 3/2019
(Continued)

OTHER PUBLICATIONS

Extended European Search Report in European Appln. No. 22763473.0, mailed on Feb. 13, 2025, 9 pages.
(Continued)

*Primary Examiner* — Spencer E. Bell
(74) *Attorney, Agent, or Firm* — Fish & Richardson P.C.

(57) ABSTRACT

The preset disclosure relates to a dishwasher. The dishwasher includes: a tub defining a washing space; a sump disposed below the tub and configured to store wash water therein; a pump configured to supply the wash water stored in the sump to the tub; and a spray arm configured to supply wash water flowing from the pump to the washing space. The spray arm includes: a spray blade configured to spray wash water into the washing space; a bubble generator having therein a bubble generation flow path of a venturi tube shape and configured to supply wash water containing a microbubble to the washing space; and a hub configured to supply wash water discharged from the pump to the spray blade or the bubble generator. The spray arm sprays wash water through the spray blade while simultaneously generating a microbubble through the bubble generator.

19 Claims, 9 Drawing Sheets

(56) References Cited

FOREIGN PATENT DOCUMENTS

| | | | |
|---|---|---|---|
| CN | 109589066 | A | 4/2019 |
| CN | 109589068 | | 4/2019 |
| CN | 109589070 | B | 4/2019 |
| CN | 110876599 | A | 3/2020 |
| CN | 111407205 | | 7/2020 |
| KR | 10-2017-0139801 | | 12/2017 |
| KR | 10-2018-0103383 | | 9/2018 |
| KR | 10-2041434 | | 11/2019 |

OTHER PUBLICATIONS

International Search Report in International Appln. No. PCT/KR2022/001581, mailed on May 16, 2022, 4 pages (with English translation).

* cited by examiner

DISHWASHER

CROSS-REFERENCE TO RELATED APPLICATIONS

This application is a National Stage application under 35 U.S.C. § 371 of International Application No. PCT/KR2022/001581, filed on Jan. 28, 2022, which claims the benefit of Korean Patent Application No. 10-2021-0029555, filed on Mar. 5, 2021. The disclosures of the prior applications are incorporated by reference in their entirety.

TECHNICAL FIELD

The present disclosure relates to a dishwasher.

BACKGROUND ART

A dishwasher is a home appliance that removes food residue remaining on dishes by spraying wash water. Korean Laid-Open Patent Publication No. KR 10-2018-0015929, which is hereby incorporated by reference, discloses a dishwasher including a microbubble generator configured to generate microbubbles in wash water to increase washing performance.

As disclosed in the patent publication, microbubbles are generated in wash water sprayed onto the dishes for the purpose of achieving chemical cleaning ability using the activating effect of detergent to improve the washing performance. To this end, a structure in which a microbubble generator is installed in a space of a drive unit at the bottom of the dishwasher.

However, in the microbubble generator structure, a washing pump is connected to a tub by using the lower space of the tub. Such a structure may require a complicated flow path structure and cause an increase in the number of parts for flow path connection and material costs. In addition, since it is installed in the space of the drive unit, air intake noise is exposed to the outside. Therefore, an additional part for noise reduction is required in order to address this problem.

DISCLOSURE OF INVENTION

Technical Problem

It is an objective of the present disclosure to provide a dishwasher capable of generating microbubbles to spray the same onto the dishes in a tub without requiring a separate space for generating the microbubbles. That is, the objective is to provide a dishwasher capable of generating and supplying microbubbles to a tub with a simple configuration.

It is another objective of the present disclosure to provide a dishwasher capable of achieving not only physical cleaning ability by spraying high-pressure wash water through a spray arm but also chemical cleaning ability by spraying wash water containing microbubbles.

The objectives of the present disclosure are not limited to the objectives described above, and other objectives not stated herein will be clearly understood by those skilled in the art from the following description.

Technical Solution

According to an aspect of the subject matter described in this application, a dishwasher includes: a tub defining a washing space; a sump disposed below the tub and configured to store wash water therein; a pump configured to supply the wash water stored in the sump to the tub; and a spray arm configured to supply wash water flowing from the pump to the washing space. The spray arm includes: a spray blade configured to spray wash water into the washing space; a bubble generator configured to supply wash water containing a microbubble to the washing space; and a hub configured to supply wash water discharged from the pump to the spray blade or the bubble generator. The spray arm may spray wash water through the spray blade while simultaneously generating a microbubble through the bubble generator, allowing wash water containing microbubbles to be supplied to the washing space.

A flow path area of an inlet end of the bubble generator may be less than a flow path area of an inlet end of the spray blade, thereby achieving the flow rate of wash water sprayed toward the dishes and maintaining the spray pressure of wash water at a certain level or higher.

The bubble generator may have therein a bubble generation flow path to generate the microbubble. The bubble generation flow path may include: a first expansion passage extending from an inlet end of the bubble generator and providing an increased flow path cross-sectional area; a reduction passage extending from the first expansion passage and providing a decreased flow path cross-sectional area; and a second expansion passage extending from the reduction passage and providing an increased flow path cross-sectional area. An inlet hole through which air is introduced may be formed between the reduction passage and the second expansion passage, thereby generating microbubbles in wash water passing through the bubble generator.

The bubble generation flow path may further include an inlet passage connected to an inside of the hub. A length of the inlet passage in a flow direction of wash water may be greater than a diameter of the inlet passage, allowing the flow rate of wash water introduced into the bubble generator to be small.

The bubble generator may be provided with an air flow path to supply air outside the bubble generator to the inlet hole. The air flow path may be formed in a direction perpendicular to the bubble generation flow path, allowing air inside the tub to be introduced into the bubble generation flow path.

The air flow path may have a bent structure, thereby preventing foreign matter in the tub from entering the bubble generator.

The bubble generation flow path may further include an extension passage that extends from the second expansion passage. The bubble generator may have a plurality of holes to discharge wash water flowing through the extension passage, allowing microbubbles generated in the bubble generator to be discharged to the tub.

The plurality of holes may be formed in a top surface or a bottom surface of the bubble generator, allowing microbubbles generated in the bubble generator to be discharged to the tub.

The spray blade may include a first spray blade that extends from the hub in one direction, and a second spray blade that extends from the hub in an opposite direction to the first spray blade. The bubble generator may include a first bubble generator that extends from the hub in another direction, and a second bubble generator that extends from the hub in an opposite direction to the first bubble generator. The first spray blade and the second spray blade may be disposed to cross the first bubble generator and the second bubble generator. That is, two spray blades and two bubble generators may be arranged to intersect each other to thereby secure wash water sprayed toward the dishes while achieving the amount of microbubble generation at a certain level or higher.

The first spray blade and the second spray blade may each be provided on a top surface thereof with a plurality of spray nozzles. The plurality of spray nozzles may be configured to spray wash water in an inclined direction of the top surface of each of the first spray blade and the second spray blade, thereby causing the spray arm to rotate in one direction.

In another aspect, a dishwasher includes: a tub defining a washing space; a sump disposed below the tub and configured to store wash water therein; a pump configured to supply the wash water stored in the sump to the tub; and a spray arm assembly configured to supply wash water flowing from the pump to the washing space. The spray arm assembly includes: a spray arm rotatably disposed on the tub and configured to spray wash water into the washing space; a fixed gear part fixed to one side of the tub; a rotating gear part rotatably mounted to a bottom surface of the spray arm and engaged with the fixed gear part, and a link member mounted to the spray arm and connected to the rotating gear part. The spray arm includes: a spray blade configured to spray wash water into the washing space and configured to allow the spray arm to rotate in a first direction; a moving blade configured to spray wash water into the washing space, and allowing, according to placement, the spray arm to rotate in the first direction or a second direction opposite to the first direction; a bubble generator configured to supply wash water containing a microbubble to the washing space; and a hub configured to supply wash water discharged from the pump to the spray blade, the bubble generator, or the moving blade. The link member may change the placement of the moving blade according to rotation of the rotating gear part, thereby allowing the spray arm assembly to rotate in both directions while generating microbubbles in the spray arm.

A flow path area of an inlet end of the bubble generator may be less than a flow path area of an inlet end of the spray blade or a flow path area of an inlet end of the moving blade, thereby securing the amount of wash water sprayed toward the dishes.

The moving blade may include a fixed tube that is disposed to be fixed to the hub and extends from the hub, and a moving tube that is rotatably disposed on the fixed tube, allowing the direction of wash water sprayed from the moving blade to be changed.

The spray blade may include a first spray blade that extends from the hub in one direction, and a second spray blade that extends from the hub in an opposite direction to the first spray blade. The moving blade may be disposed to extend from the hub between the first spray blade and the second spray blade. The bubble generator may be disposed to extend from the hub in an opposite direction to the moving blade. Thus, the amount of wash water sprayed toward the dishes may be achieved by two spray blades, the rotation direction of the spray arm may be adjusted by one moving blade, and microbubbles may be generated by one bubble generator.

The rotating gear part may be rotatably disposed on a bottom surface of the spray blade.

The link member may include a first extension portion mounted to the first spray blade, a second extension portion mounted to the second spray blade, a third extension portion mounted to the bubble generator, and a fourth extension portion mounted to the moving blade. The rotating gear part may include a protrusion that is radially spaced apart from a rotation axis of the rotating gear part and protrudes to one side. The first extension portion may be provided with a guide groove into which the protrusion is inserted and converting a rotary motion of the protrusion to a linear motion of the link member in one direction to thereby covert a rotary motion of the rotating gear part to a linear motion of the link member, allowing the placement of the moving blade to be changed.

Details of other embodiments are included in the detailed description and the accompanying drawings.

Advantageous Effects

The dishwasher according to the present disclosure has one or more of the following effects.

First, as a spray arm includes a spray blade to spray wash water and a bubble generator configured to generate a microbubble, microbubbles can be generated and sprayed toward the dishes. Since it does not require a separate space for the bubble generator or a separate configuration, unnecessary space in the dishwasher can be removed, and costs can be reduced.

Second, as wash water is sprayed onto the dishes by adjusting the flow rate in the spray arm, and wash water containing the microbubbles is ultimately sprayed onto the dishes by generating microbubbles, the washing performance of the dishwasher can be improved.

The effects of the present disclosure are not limited to the effects described above, and other effects not mentioned will be clearly understood by those skilled in the art from the claims.

MODE FOR INVENTION

Figure 1:
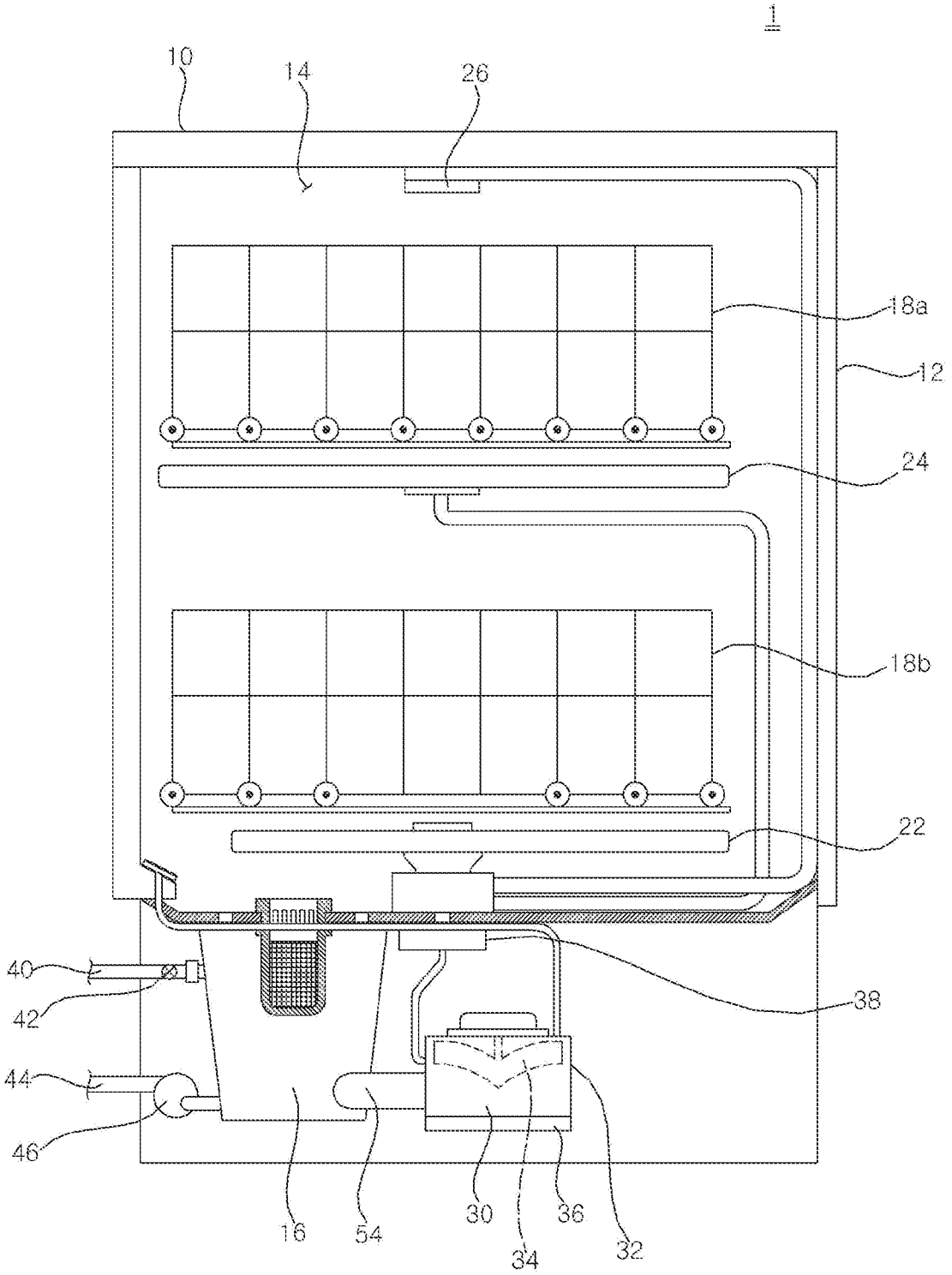
FIG. 1 is a schematic cross-sectional view of a dishwasher according to an embodiment of the present disclosure.
Figure 2:
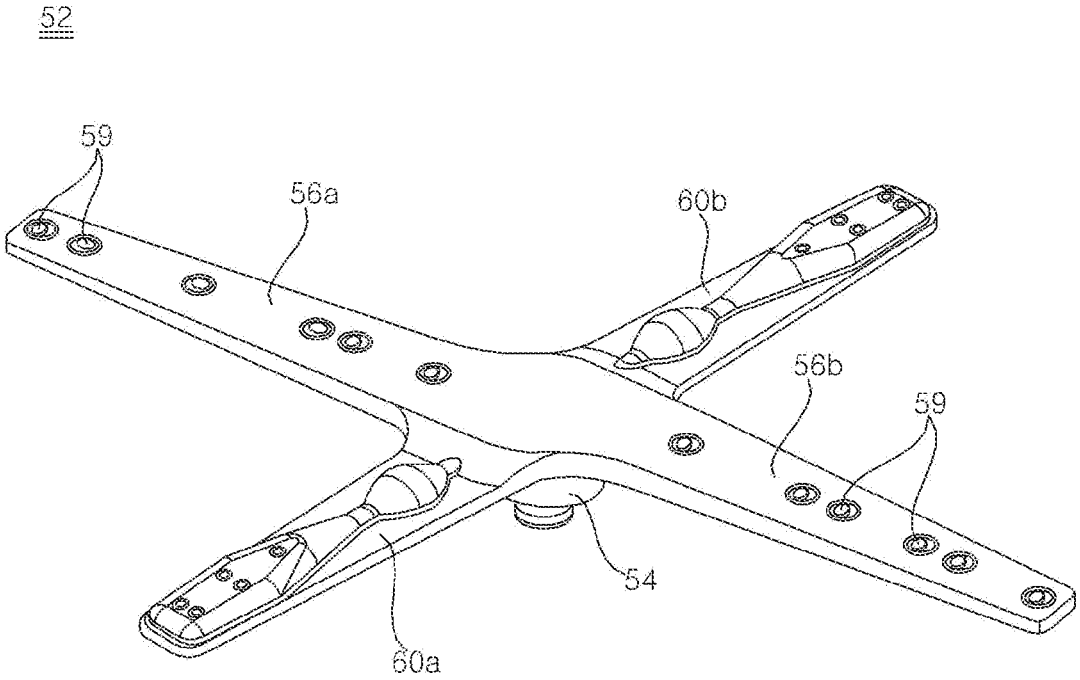
FIG. 2 is a perspective view of a spray arm according to a first embodiment of the present disclosure.

The above and other aspects, features and other advantages of the present disclosure will be more clearly understood from the following detailed description taken in conjunction with the accompanying drawings. Exemplary embodiments will now be described more fully hereinafter with reference to the accompanying drawings; however, they may be embodied in many different forms and should not be construed as limited to the embodiments set forth herein. Rather, these embodiments are provided so that this disclosure will be thorough and complete, and will fully convey the scope of the exemplary embodiments to those skilled in the art. The same reference numerals are used throughout the drawings to designate the same or similar components.

Hereinafter, a dishwasher according to embodiments of the present disclosure will be described with reference to the accompanying drawings.

The dishwasher of the present disclosure includes a cabinet 10 that defines an outer shape, a tub 12 that is disposed inside the cabinet 10 and defines a washing space 14, a sump 16 that is disposed below the tub 12 and stores wash water temporarily, a rack (18*a*, 18*b*) that is disposed inside the tub 12 and on which dishes are placed, a spray arm (22, 24) that sprays wash water into the washing space 14, and a washing pump 30 that supplies the wash water stored in the sump 16 to the spray arm (22, 24).

The washing pump 30 may be disposed separately from the sump 16. The washing pump 30 includes a pump housing 32 that defines an outer shape, an impeller 34 that causes wash water to flow, and a heater 36 that heats water in the pump housing 32.

The dishwasher 1 includes an upper rack 18*a*, a lower rack 18*b* disposed below the upper rack 18*a*, a lower spray arm 22 rotatably disposed below the lower rack 18*b* to spray wash water, an upper spray arm 24 rotatably disposed below the upper rack 18*a* to spray wash water, and a top spray nozzle 26 disposed at an upper end portion of the washing space 14 to spray wash water downward.

The dishwasher 1 includes a switching valve 38 to supply wash water discharged from the washing pump 30 to the lower spray arm 22, the upper spray arm 24, or the top spray nozzle 26.

The dishwasher 1 may further include a water supply pipe 40 to supply wash water from an external water source, a water supply valve 42 to open and close the water supply pipe 40, a discharge pipe 44 to discharge wash water stored in the sump 16 to the outside, and a discharge pump 46 that discharges wash water stored in the sump 16 to the outside through the discharge pipe 44.

Hereinafter, a spray arm 52 according to a first embodiment of the present disclosure will be described with reference to FIGS. 2 to 8.

The spray arm 52 described herein may be the lower spray arm 22 shown in FIG. 1. However, the spray arm 52 may also be applicable to the upper spray arm 24 shown in FIG. 1.

The spray arm 52 may include a plurality of blades (56*a*, 56*b*, 60*a*, 60*b*) that extend in different directions and spray wash water into the washing space 14, and a hub 54 that supplies wash water discharged from the washing pump 30 to the plurality of blades (56*a*, 56*b*, 60*a*, 60*b*).

The hub 54 may form a flow path or passage in an up-and-down or vertical direction to allow the wash water supplied from the washing pump 30 to flow upward. The plurality of blades (56*a*, 56*b*, 60*a*, 60*b*) may be disposed on an upper end portion of a peripheral surface 54*b* of the hub 54.

Figure 3:
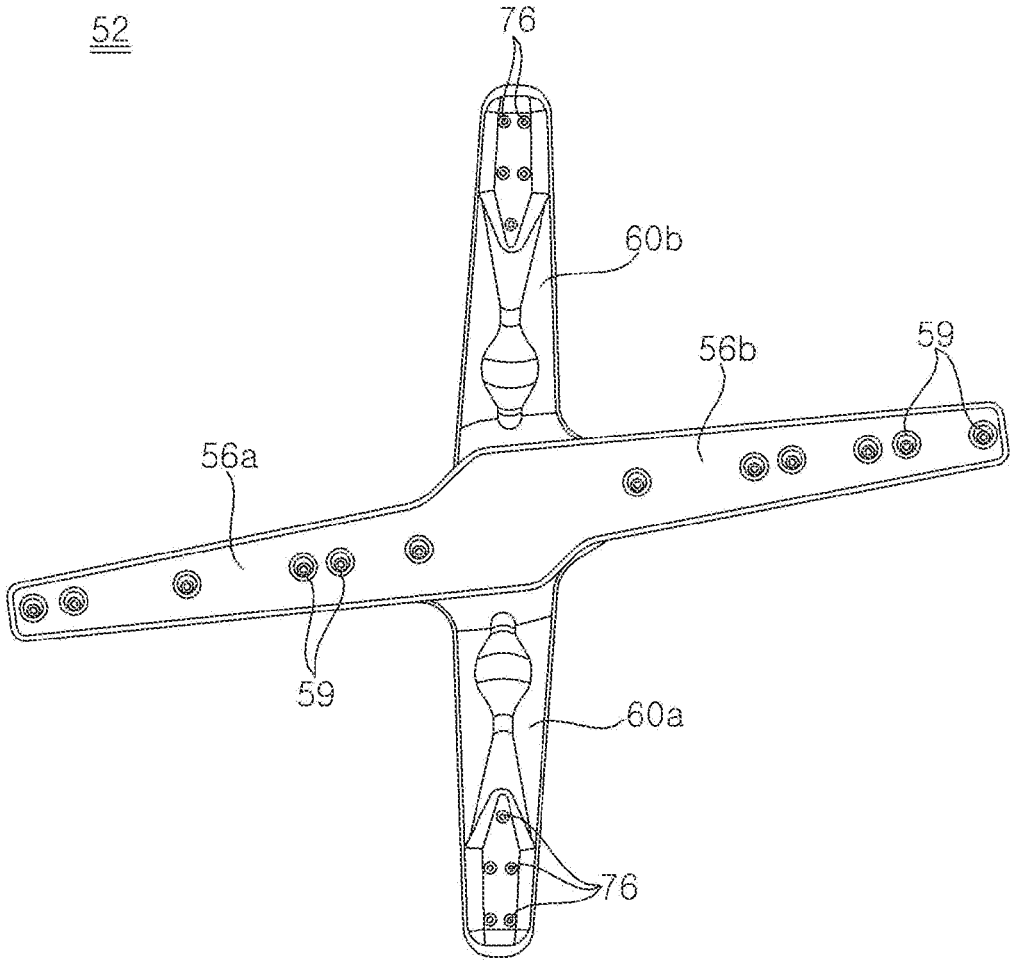
FIG. 3 is a top plan view of the spray arm according to the first embodiment of the present disclosure.

Referring to FIG. 3, the spray arm 52 may consist of an upper cover 52*a* and a lower cover 52*b*. The upper cover 52*a* and the lower cover 52*b* may be coupled to each other to define therein a flow path through which wash water flows.

Figure 5:
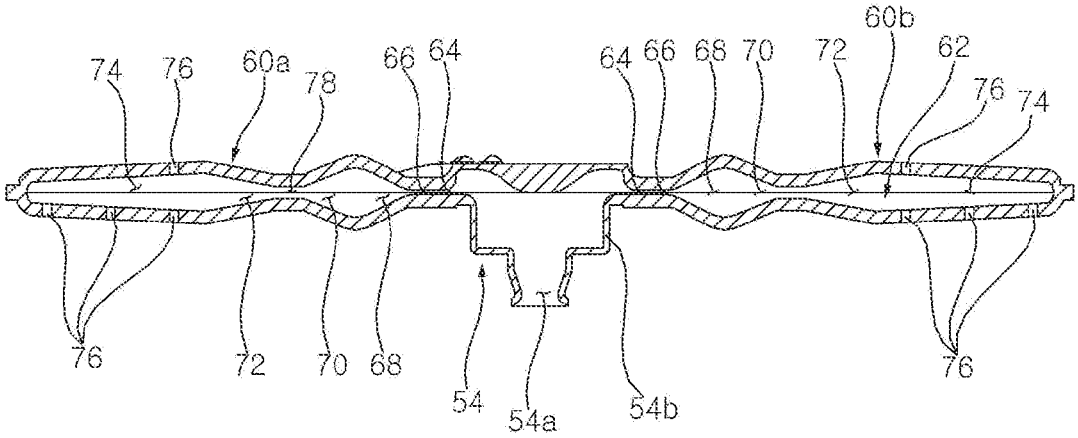
FIG. 5 is a cross-sectional view taken along line V-V' of FIG. 3.

Referring to FIG. 5, the hub 54 has an opening 54*a* open at bottom. The hub 54 is disposed at the lower cover 52*b*.

The plurality of blades (56*a*, 56*b*, 60*a*, 60*b*) include a spray blade 56*a*, 56*b* to spray wash water into the washing space 14, and a bubble generator 60 having therein a venturi tube-shaped flow path to supply wash water containing a microbubble to the washing space. The bubble generator 60 supplies a microbubble to the washing space. The microbubble may refer to a plurality of bubbles crushed into fine size in the wash water.

Referring to FIG. 3, the spray arm 52 includes two spray blades 56*a* and 56*b*, and two bubble generators 60. The spray blade 56*a*, 56*b* includes a first spray blade 56*a* that extends from the hub 54 in one direction, and a second spray blade 56*b* that extends in a different direction from the first spray blade 56*a*.

Figure 7:
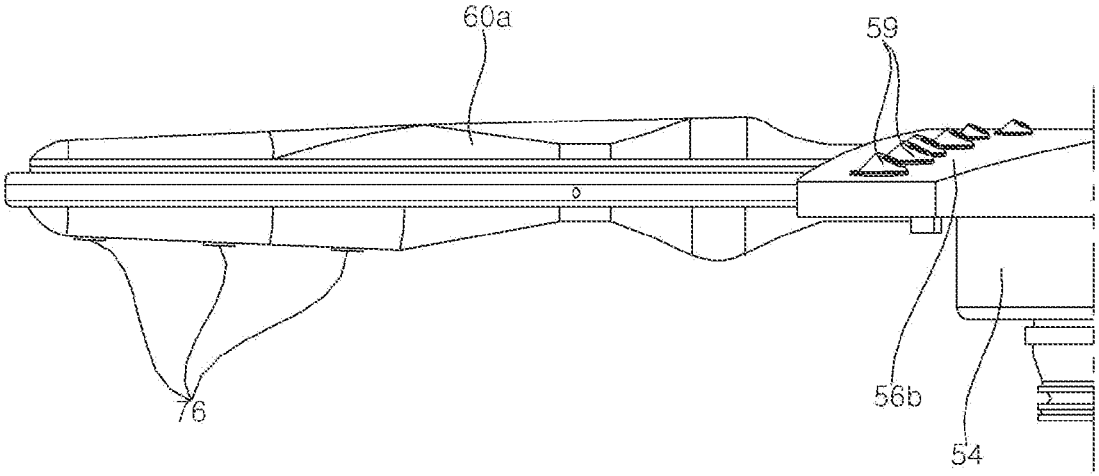
FIG. 7 is a side view of one side of the spray arm according to the first embodiment of the present disclosure.

The first spray blade 56*a* and the second spray blade 56*b* are each provided on its top surface with a plurality of spray nozzles 59. Referring to FIG. 7, the plurality of spray nozzles 59 may spray wash water in an inclined direction of the top surface of each of the first spray blade 56*a* and the second spray blade 56, thereby causing the spray arm 52 to rotate in one direction.

The spray blade 56*a*. 56*b* is provided therein with a spray flow path 57 through which wash water supplied from the hub 54 flows. A cross-sectional area of the spray flow path 57 may decrease as a distance from the hub 54 increases.

The bubble generator 60 includes a first bubble generator 60*a* that extends from the hub 54 in one direction, and a second bubble generator 60*b* that extends in a different direction from the first bubble generator 60*a*.

The first bubble generator 60*a* and the second bubble generator 60*b* may be arranged to extend in opposite directions between the first spray blade 56*a* and the second spray blade 56*b*. Referring to FIG. 3, the first bubble generator 60*a* and the second bubble generator 60*b* may each be disposed substantially perpendicular to the first spray blade 56*a* and the second spray blade 56*b*.

Figure 6:
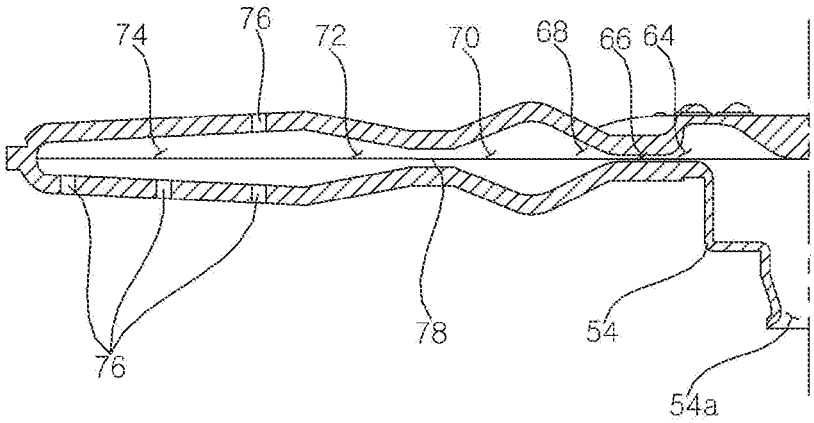
FIG. 6 is an enlarged view of B of FIG. 5.

Referring to FIGS. 5 and 6, the bubble generator 60 is provided therein with a bubble generation flow path 62 of a venturi-tube shape. The bubble generation flow path 62 includes an inlet passage 66 that is connected to the hub 54, a first expansion passage 68 that is connected to the inlet passage 66 and in which the cross-sectional area of the flow path increases, a reduction passage 70 that is connected to the first expansion passage 68 and in which the cross-sectional area of the flow path decreases, a second expansion passage 72 that is connected to the reduction passage 70 and in which the cross-sectional area of the flow path increases again, and a discharge passage 74 that is connected to the second expansion passage 72 and discharges wash water to the outside.

Figure 4:
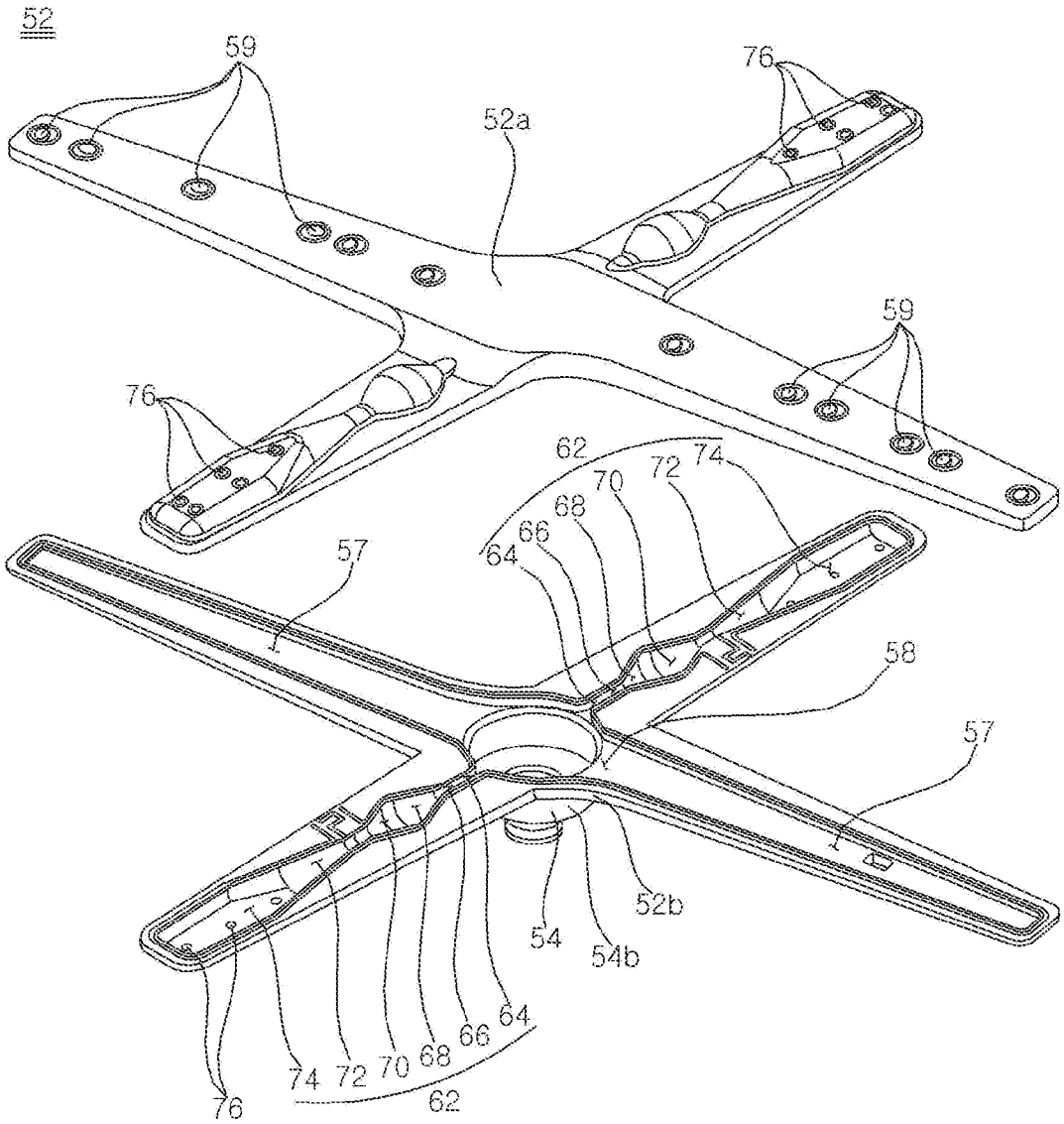
FIG. 4 is an exploded perspective view of the spray arm according to the first embodiment of the present disclosure.

Referring to FIG. 4, the flow path area of an inlet end 64 of the bubble generator 60 is formed smaller than the flow path area of an inlet end 58 of the spray blade 56*a*, 56*b*. That is, the flow path cross-sectional area of the inlet passage 66 is less than the area of an inlet end of the spray flow path 57 formed inside the spray blade 56*a*, 56*b*. As the amount of wash water supplied to the spray blade 56*a*, 56*b* is greater than the amount of wash water supplied to the bubble generator 60, washing performance may be achieved.

The first expansion passage 68 extends from the inlet passage 66 in the flow direction of wash water. The increase rate of the cross-sectional area of the first expansion passage 68 may be greater than the increase rate of the cross-sectional area of the second expansion passage 72. As the flow path area of the first expansion passage 68 increases, the flow rate of wash water flowing through the bubble generation flow path 62 may be achieved.

Referring to FIG. 6, the reduction passage 70 extends from the first expansion passage 68 in the flow direction of wash water. As the cross-sectional area of the flow path gradually decreases, the pressure of wash water flowing through the reduction passage 70 may be reduced. By adjusting the ratio of the flow path cross-sectional area of the reduction passage 70, the pressure at an outlet end of the reduction passage 70 may be lower than the atmospheric pressure.

An air hole 78 in communication with an outside of the bubble generator 60 is formed at the outlet end of the reduction passage 70. The bubble generator 60 is provided with an air flow path 80 through which the bubble generation flow path 62 and the outside of the bubble generator 60 communicate with each other. The air hole 78 provides communication between the air flow path 80 and the bubble generation flow path 62.

Referring to FIG. 6, the air hole 78 is disposed between the reduction passage 70 and the second expansion passage 72. Accordingly, air may be introduced into the outlet end of the reduction passage 70 in which wash water with reduced pressure flows.

Figure 8:
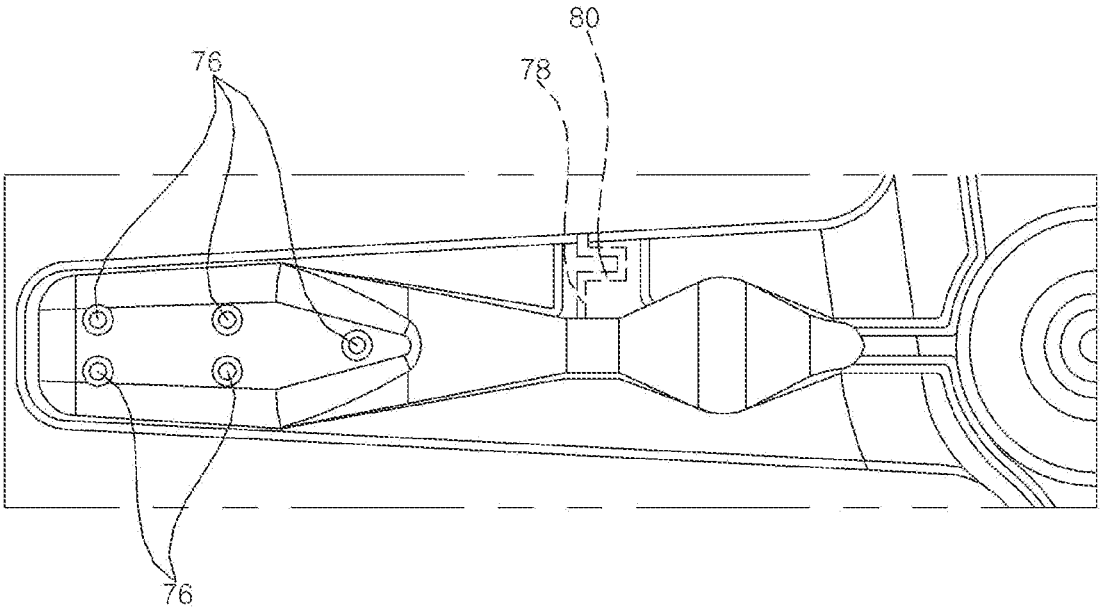
FIG. 8 is an enlarged view of A of FIG. 3.

Referring to FIG. 8, the air flow path 80 may be formed in a direction perpendicular to the bubble generation flow path 62. Referring to FIG. 8, the air flow path 80 may have a bent shape. Due to the bent shape of the air flow path 80, foreign matter be prevented from entering the bubble generation flow path 62.

Air outside the bubble generator 60 may flow into the bubble generation flow path 62 through the air flow path 80.

The second expansion passage 72 extends from the reduction passage 70. As the pressure of wash water flowing through the second expansion passage 72 increases, air introduced into the air hole 78 may be crushed. That is, the air included in the wash water flowing through the second expansion passage 72 may be crushed due to a pressure increase in the wash water to thereby generate microbubbles.

The discharge passage 74 extends from the second expansion passage 72. The flow path area of the discharge passage 74 may be maintained or partially reduced in the flow direction of wash water. A plurality of discharge holes 76 are formed in the bubble generator 60 in which the discharge passage 74 is provided. The plurality of discharge holes 76 may be formed on the top or bottom of the bubble generator 60.

Hereinafter, a spray arm according to a second embodiment of the present disclosure will be described with reference to FIGS. 9 to 11.

Figure 9:
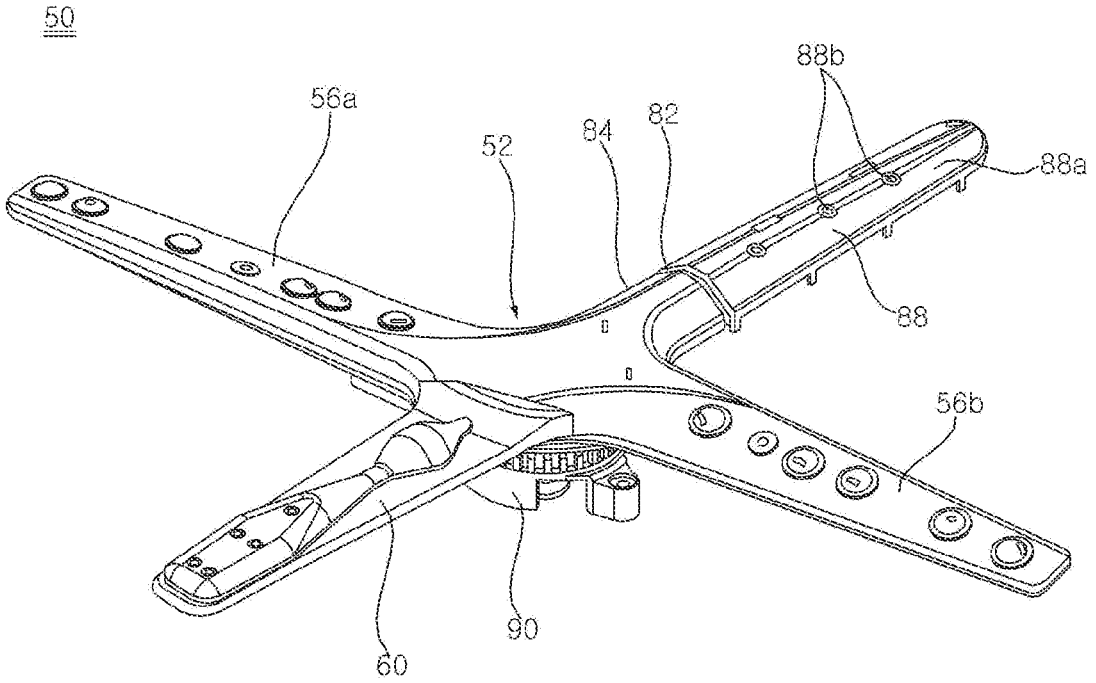
FIG. 9 is a perspective view of a spray arm assembly according to a second embodiment of the present disclosure.

Referring to FIG. 9, the spray arm 52 may include a plurality of blades (56*a*, 56*b*, 60, 82) that extend in different directions and spray wash water into the washing space 14, and a hub 54 that supplies wash water discharged from the washing pump 30 to the plurality of blades (56*a*, 56*b*, 60, 82).

The plurality of blades (56*a*, 56*b*, 60, 82) include two spray blades 56*a* and 56*b* that extend in different directions, one bubble generator 60, and one moving blade 82.

The two spray blades 56*a* and 56*b* extend in opposite directions with respect to the hub 54. The spray blade 56*a*, 56*b* includes a first spray blade 56*a* that extends from the hub 54 in one direction, and a second spray blade 56*b* that extends in a different direction from the first spray blade 56*a*.

A top surface (57*a*, 57*b*) of each of the first spray blade 56*a* and the second spray blade 56*b* may have a shape inclined to the ground in one direction. The top surface 57*a* of the first spray blade 56*a* and the top surface 57*b* of the second spray blade 56*b* may be configured as inclined surfaces formed in different directions from each other. Thus, when wash water is supplied to the first spray blade 56*a* and the second spray blade 56*b*, the spray arm 52 may be rotated in a direction opposite to a direction in which the wash water is sprayed. That is, the first spray blade 56*a* and the second spray blade 56*b* may allow the spray arm 52 to rotate in a first direction.

The moving blade 82 is disposed between the first spray blade 56*a* and the second spray blade 56*b*. The moving blade 82 may reciprocate in an extension direction from the hub 54 as a rotation axis.

The moving blade 82 includes a fixed tube 84 that is disposed to be fixed to the hub 54 and extends from the hub 54, and a moving tube 88 that is rotatably disposed on the fixed tube 84. The fixed tube 84 is provided at its end portion with a bridge 86 that is inserted into the moving tube 88 and defines a flow path through which wash water flows.

An upper surface 88*a* of the moving tube 88 is provided with a plurality of spray holes 88*b* through which wash water flowing inside is sprayed to the outside. The moving tube 88 is disposed on the fixed tube 84 to be movable in a circumferential direction. The moving tube 88 is connected to a link member 98, which will be described later, so as to change a direction that the spray hole 88*b* faces. According to the placement or disposition, the moving tube 88 may allow the spray arm 52 to rotate in a second direction.

Figure 11:
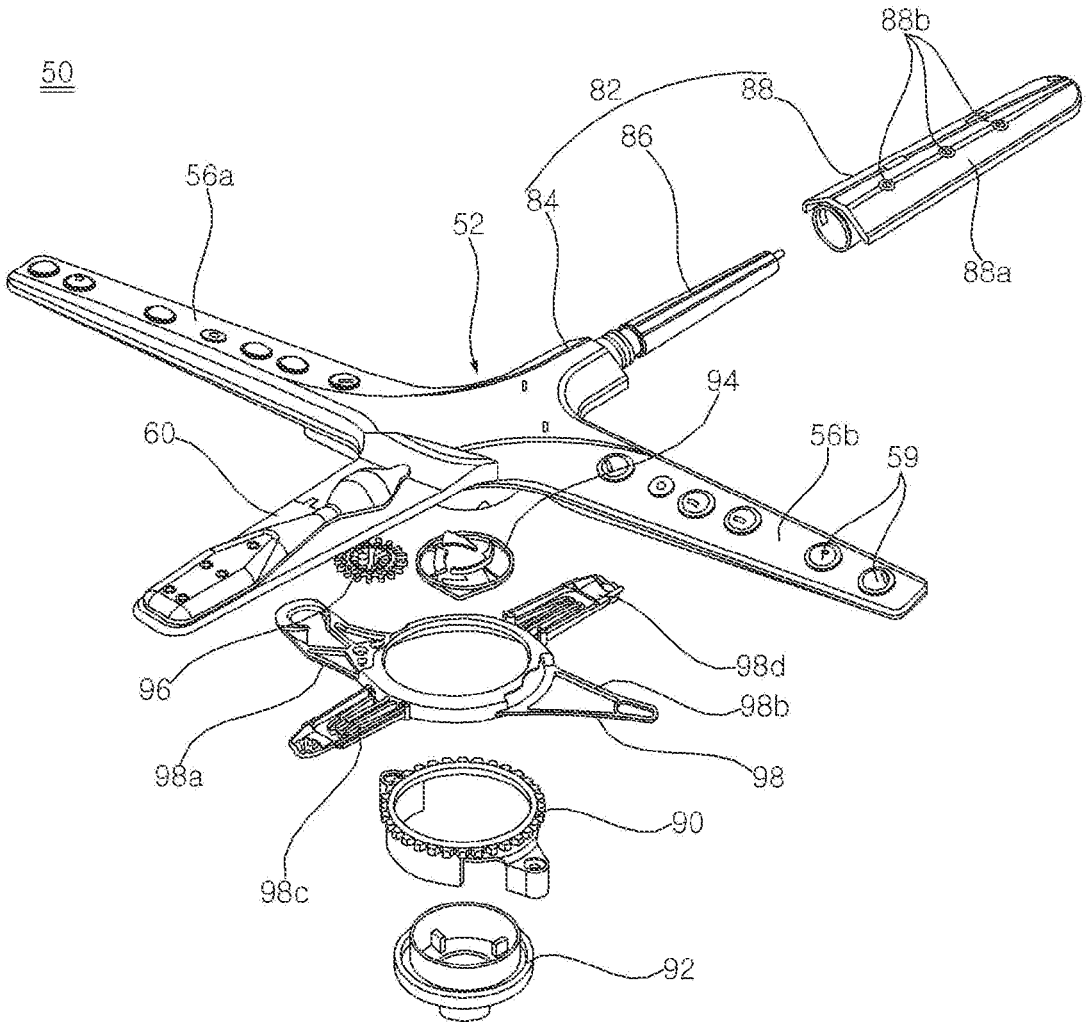
FIG. 11 is an exploded perspective view of the spray arm assembly according to the second embodiment of the present disclosure.

Referring to FIG. 11, the spray arm 52 may be a part of a spray arm assembly 50 rotating clockwise or counterclockwise within the tub 12.

The spray arm assembly 50 may include a spray arm 52 that is provided with a plurality of blades (56*a*, 56*b*, 60, 82), a fixed gear part 90 that is mounted on one side of the tub 12, an arm holder 92 that is coupled to the spray arm 52 and fixed to the spray arm 52, a flow path switching part 94 that is accommodated in the arm holder 92 and is configured to change the flow path of wash water supplied to the spray arm, a rotating gear part 96 that is rotatably mounted to a bottom surface of the spray arm and is engaged with the fixed gear part, and a link member 98.

The fixed gear part 90 may be mounted to a bottom surface of the tub 12. The fixed gear part 90 may be mounted to a sump cover (not shown) disposed on top of the sump 16. The fixed gear part 90 is disposed to be engaged with the rotating gear part 96. When the spray arm 52 is rotated, the rotating gear part 96 may rotate in mesh with the circumference of the fixed gear part 90.

The arm holder 92 may be coupled to the spray arm 52 and fixed to the spray arm 52. The arm holder 92 may rotate together with the spray arm 52, and may serve as a central axis of rotation of the spray arm 52.

The arm holder 92 may be rotatably fixed to the tub 12 while being coupled to the spray arm 52. The arm holder 92 may be rotatably fixed to the sump cover (not shown). Wash water supplied from the washing pump 30 flows into the arm holder 92 and is then supplied to the spray arm 52.

Alternatively, the arm holder 92 may be integrally formed with the spray arm 52.

The flow path switching part 94 is disposed in the arm holder 92. The flow path switching part 94 may switch the flow path of wash water supplied from the arm holder 92 to the spray arm 52.

The rotating gear part 96 may be rotatably mounted to the bottom surface of the spray arm 52. When the spray arm 52 is rotated, the rotating gear part 96 may perform a circular motion along the circumference of the fixed gear part 90 fixed to the sump cover while rotating in engagement with the fixed gear part 90.

The rotating gear part 96 may be rotatably disposed on a bottom of one of the first spray blade 56*a* and the second spray blade 56*b*. Referring to FIG. 10, the rotating gear part 96 may be disposed on the bottom of the first spray blade 56*a*. The first spray blade 56*a* is provided on its bottom with a first mounting protrusion 59*a* to which one side of the link member 98 is mounted.

The rotating gear part 96 may include a protrusion 96*a* that is spaced apart from a rotation axis of the rotating gear part 96 and protrudes to one side.

When the rotating gear part 96 rotates, the protrusion 96*a* may rotate at a position spaced apart from the center of the rotating gear part 96. The protrusion rotates as the rotating gear part 96 rotates, allowing the placement of the link member 98 to be changed.

The link member 98 may be mounted to the spray arm 52. The link member 98 is connected at one side to the protrusion of the rotating gear part 96 and at the other side to the moving tube 88 of the moving blade 82. The link member 98 moves in one direction as the rotating gear part 96 rotates, allowing the placement of the moving tube 88 to be changed.

As the protrusion of the rotating gear part 96 rotates, the link member 98 may allow the moving tube 88 to perform a reciprocating rotational motion in a longitudinal direction.

Figure 10:
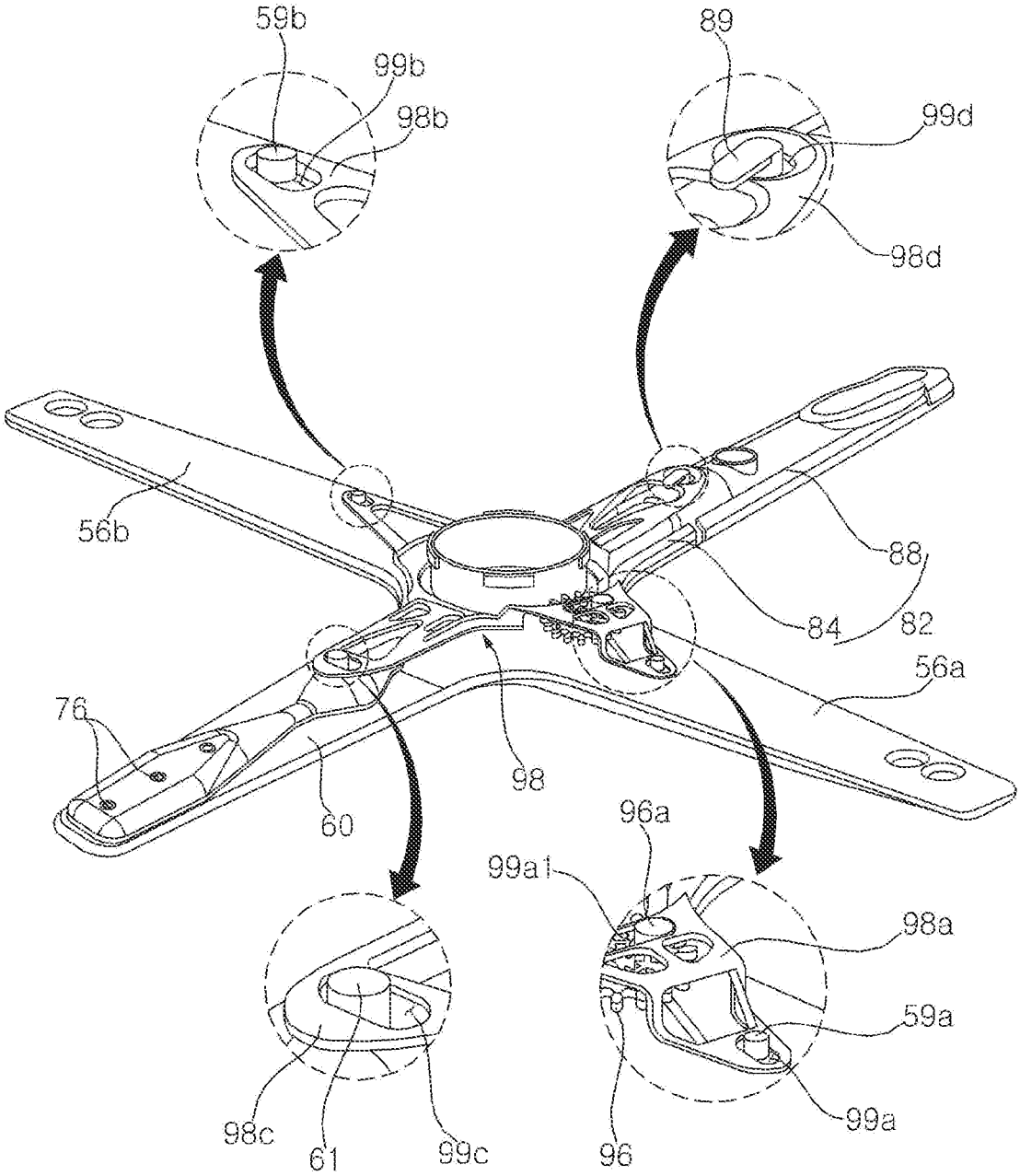
FIG. 10 is a bottom perspective view showing a coupled state of a spray arm and a link member, according to the second embodiment of the present disclosure.

Referring to FIG. 10, the link member 98 is disposed around the hub 54. The link member 98 includes a first extension portion 98*a* that is mounted to the first spray blade 56*a*, a second extension portion 98*b* that is mounted to the second spray blade 56*b*, a third extension portion 98*c* that is mounted to the bubble generator 60, and a fourth extension portion 98*d* that is mounted to the moving blade 82.

Referring to FIG. 10, the first extension portion 98*a* is provided at its end portion with a first mounting groove 99*a* into which the first mounting protrusion 59*a* of the first spray blade 56*a* is inserted. The first mounting groove 99*a* defines a long elliptical groove in a direction in which the first spray blade 56*a* extends. Accordingly, the first mounting groove 99*a* may guide the link member 98 to move in a longitudinal direction of the spray blade.

The first extension portion 98*a* is provided with a guide groove 99*al* into which the protrusion 96*a* of the rotating gear part 96 is inserted. The guide groove 99*al* may define a long elliptical groove in a direction perpendicular to the first mounting groove 99*a*. The guide groove 99*al* may convert a rotary motion of the protrusion 96*a* of the rotating gear part 96 to a linear motion of the link member 98 in one direction. Thus, according to the rotation of the rotating gear part 96, the link member 98 may perform a linear motion in the longitudinal direction of the spray blade.

The second extension portion 98*b* is provided at its end portion with a second mounting groove 99*b* into which a second mounting protrusion 59*b* formed on the second spray blade 56*b* is inserted. The second mounting groove 99*b* has the same shape as the first mounting groove 99*a*, so as to guide the link member 98 to move in the longitudinal direction of the spray blade.

The third extension portion 98*c* is provided at its end portion with a third mounting groove 99*c* into which a third mounting protrusion 61 formed on the bubble generator 60 is inserted. The third mounting groove 99*c* may have a long elliptical shape in the same direction as the first mounting groove 99*a*. Thus, the third mounting groove 99*c* may also guide the link member 98 to move in the longitudinal direction of the spray blade.

The fourth extension portion 98*d* is provided at its end portion with a fixing groove 99*d* into which a fixing protrusion 89 formed on a lower portion of the moving tube 88 is inserted. The fixing protrusion 89 may be inserted into the fixing groove 99*d*, so that one end of the link member 98 and one side of the moving tube 88 may be fixed or secured. Accordingly, the moving tube 88 may move when the link member 98 moves in the longitudinal direction of the spray blade. In other words, the moving tube 88 may perform a reciprocating motion with respect to a rotation axis defined in a direction in which the moving blade 82 extends.

When the moving tube 88 sprays wash water while performing the reciprocating motion, the rotation direction of the spray arm 52 may be changed from the first direction to the second direction.

Although preferred embodiments of the present disclosure have been shown and described herein, the present disclosure is not limited to the specific embodiments described above. It will be understood that various modifications and changes can be made by those skilled in the art without departing from the idea and scope of the present disclosure as defined by the appended claims. Therefore, it shall be considered that such modifications, changes, and equivalents thereof are all included within the scope of the present disclosure.

The invention claimed is:

1. A dishwasher comprising:

a tub that defines a washing space;

a sump disposed below the tub and configured to store wash water therein;

a pump configured to supply the wash water stored in the sump to the tub; and a spray arm configured to supply the wash water from the pump to the washing space, wherein the spray arm comprises:

a spray blade configured to spray the wash water into the washing space, a bubble generator configured to generate microbubbles in the wash water and to supply the wash water including the microbubbles to the washing space, and a hub configured to supply the wash water discharged from the pump to the spray blade or the bubble generator, wherein the spray arm is configured to spray the wash water including the microbubbles through the spray blade while the bubble generator generates the microbubbles, wherein the bubble generator defines a bubble generation flow path configured to generate the microbubbles, wherein the bubble generation flow path comprises:

a first expansion passage that extends from an inlet end of the bubble generator and defines a first increased flow path cross-sectional area, a reduction passage that extends from the first expansion passage and defines a decreased flow path cross-sectional area, and a second expansion passage that extends from the reduction passage and defines a second increased flow path cross-sectional area, and wherein the bubble generator has an inlet hole that is defined between the reduction passage and the second expansion passage and configured to introduce air into the bubble generator flow path.

2. The dishwasher of claim 1, wherein a flow path area of the inlet end of the bubble generator is less than a flow path area of an inlet end of the spray blade.

3. The dishwasher of claim 1, wherein the bubble generation flow path further comprises an inlet passage connected to an inside of the hub, and wherein a length of the inlet passage in a flow direction of wash water is greater than a diameter of the inlet passage.

4. The dishwasher of claim 1, wherein the bubble generator defines an air flow path configured to supply air from an outside of the bubble generator to the inlet hole, and wherein the air flow path is disposed perpendicular to the bubble generation flow path.

5. The dishwasher of claim 4, wherein the air flow path is curved.

6. The dishwasher of claim 1, wherein the bubble generation flow path further comprises an extension passage that extends from the second expansion passage, and wherein the bubble generator has a plurality of holes configured to discharge the wash water from the extension passage.

7. The dishwasher of claim 6, wherein the plurality of holes are defined at a top surface or a bottom surface of the bubble generator.

8. The dishwasher of claim 1, wherein the spray blade intersects the bubble generator, wherein the spray blade comprises (i) a first spray blade that extends from the hub in a first direction and (ii) a second spray blade that extends from the hub in a second direction opposite to the first direction, and wherein the bubble generator comprises (i) a first bubble generator that extends from the hub in a third direction and (ii) a second bubble generator that extends from the hub in a fourth direction opposite to the third direction.

9. The dishwasher of claim 8, wherein each of the first spray blade and the second spray blade defines a plurality of spray holes on a top surface thereof, and wherein the plurality of spray holes are configured to spray the wash water in an inclined direction with respect to the top surface of each of the first spray blade and the second spray blade to thereby cause the spray arm to rotate in a direction.

10. A dishwasher comprising:

a tub that defines a washing space;

a sump disposed below the tub and configured to store wash water therein;

a pump configured to supply the wash water stored in the sump to the tub; and a spray arm assembly configured to supply the wash water from the pump to the washing space, wherein the spray arm assembly comprises:

a spray arm rotatably disposed at the tub and configured to spray the wash water into the washing space, a fixed gear fixed to a first side of the tub, a rotating gear rotatably disposed at a bottom surface of the spray arm and engaged with the fixed gear, and a link member coupled to the spray arm and connected to the rotating gear, wherein the spray arm comprises:

a spray blade configured to spray the wash water into the washing space to thereby cause the spray arm to rotate in a first rotary direction, a moving blade configured to spray the wash water into the washing space, the moving blade being configured to, based on a position of the moving blade, cause the spray arm to rotate in the first rotary direction or a second rotary direction opposite to the first rotary direction, a bubble generator configured to generate microbubbles in the wash water and to supply the wash water including the microbubbles to the washing space, and a hub configured to supply the wash water discharged from the pump to the spray blade, the bubble generator, or the moving blade, wherein the link member is configured to change the position of the moving blade based on rotation of the rotating gear, wherein the bubble generator defines a bubble generation flow path configured to generate the microbubbles, wherein the bubble generation flow path comprises:

a first expansion passage that extends from an inlet end of the bubble generator and defines a first increased flow path cross-sectional area, a reduction passage that extends from the first expansion passage and defines a decreased flow path cross-sectional area, and a second expansion passage that extends from the reduction passage and defines a second increased flow path cross-sectional area, and wherein the bubble generator has an inlet hole that is defined between the reduction passage and the second expansion passage and configured to introduce air into the bubble generator flow path.

11. The dishwasher of claim 10, wherein a flow path area of the inlet end of the bubble generator is less than a flow path area of an inlet end of the spray blade or a flow path area of an inlet end of the moving blade.

12. The dishwasher of claim 10, wherein the moving blade comprises:

a fixed tube that is fixed to the hub and extends from the hub; and a moving tube that is rotatably disposed on the fixed tube.

13. The dishwasher of claim 10, wherein the spray blade comprises (i) a first spray blade that extends from the hub in a first direction and (ii) a second spray blade that extends from the hub in a second direction opposite to the first direction, wherein the moving blade extends in a third direction from a position of the hub between the first spray blade and the second spray blade, and wherein the bubble generator extends from the hub in a fourth direction opposite to the third direction.

14. The dishwasher of claim 10, wherein the rotating gear is rotatably disposed at a bottom surface of the spray blade.

15. The dishwasher of claim 13, wherein the link member comprises a first extension portion disposed at the first spray blade, a second extension portion disposed at the second spray blade, a third extension portion disposed at the bubble generator, and a fourth extension portion disposed at the moving blade, wherein the rotating gear comprises a protrusion that is radially spaced apart from a rotation axis of the rotating gear and protrudes to one side of the rotating gear, and wherein the first extension portion defines a guide groove that receives the protrusion, the guide groove being configured to convert a rotary motion of the protrusion to a linear motion of the link member.

16. The dishwasher of claim 12, wherein the moving tube surrounds a circumferential surface of the fixed tube.

17. The dishwasher of claim 12, wherein the moving blade further comprises a bridge that extends from the fixed tube in a direction away from the hub and is inserted into the moving tube, and wherein the moving tube surrounds a circumferential surface of the bridge.

18. The dishwasher of claim 12, wherein the moving tube defines a plurality of spray holes configured to discharge the wash water to an outside of the moving blade.

19. The dishwasher of claim 10, wherein the moving blade and the bubble generator extend from the spray blade in directions opposite to each other.

* * * * *